US006102140A

United States Patent [19]

Boyce et al.

[11] Patent Number: 6,102,140

[45] Date of Patent: Aug. 15, 2000

[54] INSERTS AND COMPACTS HAVING COATED OR ENCRUSTED DIAMOND PARTICLES

[75] Inventors: James Edward Boyce, Cedar Hill; Michael Steve Beaton, The Woodlands; Richard David Mittan, Dallas, all of Tex.

[73] Assignee: Dresser Industries, Inc., Dallas, Tex.

[21] Appl. No.: 09/008,373

[22] Filed: Jan. 16, 1998

[51] Int. Cl.[7] ..... E21B 10/46

[52] U.S. Cl. ..... 175/374; 175/426; 175/434

[58] Field of Search ..... 175/426, 434, 175/374; 407/119; 51/295

[56] References Cited

U.S. PATENT DOCUMENTS

| | | | |
|---|---|---|---|
| 3,389,761 | 6/1968 | Ott | 175/374 |
| 3,461,983 | 8/1969 | Hudson et al. | 175/375 |
| 3,497,942 | 3/1970 | Weiss | 29/470 |
| 3,575,247 | 4/1971 | Feenstra | 175/329 |
| 3,596,649 | 8/1971 | Olivieri . | |
| 3,650,714 | 3/1972 | Farkas | 51/295 |
| 3,757,878 | 9/1973 | Wilder et al. | 175/329 |
| 3,768,984 | 10/1973 | Foster, Jr. | 29/182.8 |
| 3,800,891 | 4/1974 | White et al. | 175/374 |
| 3,841,852 | 10/1974 | Wilder et al. | 51/295 |
| 3,850,590 | 11/1974 | Chalkley et al. | 51/298 |
| 3,871,840 | 3/1975 | Wilder et al. | 51/295 |
| 3,894,673 | 7/1975 | Lowder et al. | 228/122 |
| 3,922,038 | 11/1975 | Scales | 308/8.2 |
| 3,986,842 | 10/1976 | Quaas | 29/191.2 |
| 4,048,705 | 9/1977 | Blampain et al. | 29/420 |
| 4,109,737 | 8/1978 | Bovenkerk | 175/329 |
| 4,117,968 | 10/1978 | Naidich et al. | 228/124 |
| 4,140,189 | 1/1979 | Garner | 173/329 |
| 4,148,368 | 4/1979 | Evans | 175/329 |
| 4,156,329 | 5/1979 | Daniels et al. | 51/295 |
| 4,173,457 | 11/1979 | Smith | 51/309 |
| 4,173,685 | 11/1979 | Weatherly | 428/556 |

(List continued on next page.)

FOREIGN PATENT DOCUMENTS

| | | | |
|---|---|---|---|
| 0012631A | 12/1979 | European Pat. Off. . | |
| 462955 | 12/1991 | European Pat. Off. | E21B 10/56 |
| 2315777A | 8/1997 | United Kingdom . | |

OTHER PUBLICATIONS

Security/Dresser "Security Oilfield Catalog" Rock Bits, Diamond Products, Drilling Tools, *Security Means Technology*, Nov. 1991.

Security/DBS "PSF Premium Steel Tooth Bits with TECH2000 Hardfacing" 5M/4/95–SJ 1995 Dresser Industries, Inc., 1995.

Security/DBS "PSF MPSF with Diamond Tech2000 Hardfacing" 1995 Dresser Industries, Inc., 1995.

International Search Report, dated Nov. 7, 1996, re International Application PCT/US96/12462.

Security/DBS "tech.comm, The Most Complete Diamond Technology Family" 1997 Security DBS.

Pending Application No. 08/818,468 entitled "Hardfacing with Coated Diamond Particles," filed Mar. 12, 1997.

Pending Application No. 08/579,454 entitled "Hardfacing with Coated Diamond Particles," filed Dec. 12, 1995.

Clifford A. Kelto, "Rapid Omnidirectional Compaction," Special and Developing Processes, pp. 542–546 (no date).

*Primary Examiner*—William Neuder
*Assistant Examiner*—Zakiya Walker
*Attorney, Agent, or Firm*—Groover & Associates, p.c

[57] ABSTRACT

The improved insert for a ground engaging tool, with a plurality of sockets for receiving a respective insert comprises a body having first and second portions and first and second zones. The first zone may consist of tungsten carbide and metallic cobalt, with preselected dimensions adapted for press fitting within a respective socket of the ground engaging tool. The second body portion may define an earth engaging portion. The second zone may consist of encrusted diamond pellets, tungsten carbide and metallic cobalt, fused together. The first and second zones may be fused together with the first zone being substantially free of encrusted diamond pellets.

18 Claims, 3 Drawing Sheets

U.S. PATENT DOCUMENTS

| | | | |
|---|---|---|---|
| 4,182,394 | 1/1980 | Cason, Jr. | 164/4 |
| 4,228,214 | 10/1980 | Steigelman et al. | 428/212 |
| 4,262,761 | 4/1981 | Crow | 175/374 |
| 4,274,840 | 6/1981 | Housman | 51/307 |
| 4,339,009 | 7/1982 | Busby | 175/374 |
| 4,341,557 | 7/1982 | Lizenby | 75/223 |
| 4,359,335 | 11/1982 | Garner | 75/208 |
| 4,376,793 | 3/1983 | Jackson | 427/34 |
| 4,378,975 | 4/1983 | Tomlinson et al. . | |
| 4,398,952 | 8/1983 | Drake | 419/18 |
| 4,562,892 | 1/1986 | Ecer | 175/371 |
| 4,592,433 | 6/1986 | Dennis | 175/329 |
| 4,593,776 | 6/1986 | Salesky et al. | 175/375 |
| 4,597,456 | 7/1986 | Ecer | 175/371 |
| 4,604,106 | 8/1986 | Hall et al. | 51/293 |
| 4,630,692 | 12/1986 | Ecer | 175/330 |
| 4,656,002 | 4/1987 | Lizenby et al. | 419/10 |
| 4,666,797 | 5/1987 | Newman et al. | 428/681 |
| 4,679,640 | 7/1987 | Crawford | 175/374 |
| 4,682,987 | 7/1987 | Brady et al. | 51/293 |
| 4,688,651 | 8/1987 | Dysart | 175/371 |
| 4,694,918 | 9/1987 | Hall | 175/329 |
| 4,705,124 | 11/1987 | Abrahamson et al. | 175/410 |
| 4,708,752 | 11/1987 | Kar | 148/127 |
| 4,722,405 | 2/1988 | Langford, Jr. | 175/374 |
| 4,726,432 | 2/1988 | Scott et al. | 175/375 |
| 4,726,718 | 2/1988 | Meskin et al. | 408/145 |
| 4,729,440 | 3/1988 | Hall | 175/107 |
| 4,738,322 | 4/1988 | Hall et al. | 175/329 |
| 4,744,943 | 5/1988 | Timm | 419/10 |
| 4,770,907 | 9/1988 | Kimura | 427/217 |
| 4,781,770 | 11/1988 | Karr | 148/16.5 |
| 4,784,023 | 11/1988 | Dennis | 76/108 |
| 4,802,539 | 2/1989 | Hall et al. | 175/329 |
| 4,814,234 | 3/1989 | Bird | 428/564 |
| 4,836,307 | 6/1989 | Keshavan et al. | 175/374 |
| 4,861,350 | 8/1989 | Phaal et al. | 51/307 |
| 4,874,398 | 10/1989 | Ringwood | 51/293 |
| 4,938,991 | 7/1990 | Bird | 427/190 |
| 4,943,488 | 7/1990 | Sung et al. | 428/552 |
| 4,948,388 | 8/1990 | Ringwood | 51/308 |
| 4,956,012 | 9/1990 | Jacobs et al. . | |
| 4,976,324 | 12/1990 | Tibbitts | 175/329 |
| 4,985,051 | 1/1991 | Ringwood | 51/309 |
| 4,997,049 | 3/1991 | Tank et al. | 175/410 |
| 5,010,043 | 4/1991 | Ringwood | 501/90 |
| 5,025,874 | 6/1991 | Barr et al. | 175/329 |
| 5,051,112 | 9/1991 | Keshavan et al. | 51/309 |
| 5,106,393 | 4/1992 | Ringwood | 51/308 |
| 5,111,895 | 5/1992 | Griffin | 175/425 |
| 5,131,480 | 7/1992 | Lockstedt et al. | 175/374 |
| 5,143,523 | 9/1992 | Matarrese | 51/293 |
| 5,147,001 | 9/1992 | Chow et al. | 175/428 |
| 5,147,996 | 9/1992 | Carlin | 219/76.14 |
| 5,152,194 | 10/1992 | Keshavan et al. | 76/108 |
| 5,154,245 | 10/1992 | Waldenstrom et al. | 175/420 |
| 5,190,796 | 3/1993 | Iacovangelo | 427/304 |
| 5,199,832 | 4/1993 | Meskin et al. | 408/145 |
| 5,205,684 | 4/1993 | Meskin et al. | 408/145 |
| 5,206,083 | 4/1993 | Raj et al. | 428/323 |
| 5,224,969 | 7/1993 | Chen et al. | 51/295 |
| 5,230,718 | 7/1993 | Oki et al. | 51/293 |
| 5,232,469 | 8/1993 | McEachron et al. | 51/295 |
| 5,236,116 | 8/1993 | Solanski et al. | 228/178 |
| 5,248,006 | 9/1993 | Scott et al. | 175/420 |
| 5,250,086 | 10/1993 | McEachron et al. | 51/309 |
| 5,250,355 | 10/1993 | Newman et al. | 428/367 |
| 5,261,477 | 11/1993 | Brunet et al. | 164/97 |
| 5,273,125 | 12/1993 | Jurewicz | 175/420 |
| 5,279,374 | 1/1994 | Sievers et al. | 175/374 |
| 5,279,375 | 1/1994 | Tibbitts et al. | 175/428 |
| 5,282,512 | 2/1994 | Besson et al. | 175/374 |
| 5,282,513 | 2/1994 | Jones | 175/434 |
| 5,287,936 | 2/1994 | Grimes et al. | 175/331 |
| 5,288,297 | 2/1994 | Ringwood | 51/293 |
| 5,291,807 | 3/1994 | Vanderford et al. | 76/108 |
| 5,303,785 | 4/1994 | Duke | 175/57 |
| 5,308,367 | 5/1994 | Julien | 51/293 |
| 5,328,763 | 7/1994 | Terry | 428/559 |
| 5,335,738 | 8/1994 | Waldenstrom et al. | 175/420 |
| 5,337,844 | 8/1994 | Tibbitts | 175/434 |
| 5,341,890 | 8/1994 | Cawthorne et al. | 175/374 |
| 5,346,026 | 9/1994 | Pessier et al. | 175/331 |
| 5,348,108 | 9/1994 | Scott et al. | 175/432 |
| 5,348,770 | 9/1994 | Sievers et al. | 427/422 |
| 5,351,768 | 10/1994 | Scott et al. | 175/374 |
| 5,351,770 | 10/1994 | Cawthorne et al. | 175/374 |
| 5,351,771 | 10/1994 | Zahradnik | 175/374 |
| 5,351,772 | 10/1994 | Smith | 175/428 |
| 5,353,885 | 10/1994 | Hooper et al. | 175/378 |
| 5,355,750 | 10/1994 | Scott et al. | 76/108 |
| 5,370,195 | 12/1994 | Keshan et al. | 175/420 |
| 5,405,573 | 4/1995 | Clark et al. | 419/35 |
| 5,423,899 | 6/1995 | Krall et al. | 75/231 |
| 5,425,288 | 6/1995 | Evans | 76/108 |
| 5,429,200 | 7/1995 | Blackman et al. | 175/371 |
| 5,452,771 | 9/1995 | Blackman et al. | 175/353 |
| 5,469,927 | 11/1995 | Griffin | 175/432 |
| 5,486,137 | 1/1996 | Flood et al. | 451/540 |
| 5,594,931 | 1/1997 | Krall et al. | 419/5 |
| 5,606,895 | 3/1997 | Huffstutler | 76/108.4 |
| 5,609,286 | 3/1997 | Anthon | 228/56.3 |
| 5,633,084 | 5/1997 | Hiraiwa et al. | 428/403 |
| 5,647,449 | 7/1997 | Dennis | 175/434 |
| 5,667,903 | 9/1997 | Boyce | 428/558 |
| 5,755,298 | 5/1998 | Langford et al. | 175/374 |
| 5,755,299 | 5/1998 | Langford et al. | 175/375 |
| 5,839,526 | 11/1998 | Cisneros et al. . | |
| 5,880,382 | 3/1999 | Fang et al. | 75/236 |

INSERTS AND COMPACTS HAVING COATED OR ENCRUSTED DIAMOND PARTICLES

This application is related to patent applications Ser. No. 09/008,100 filed Jan. 16, 1998 entitled *Hardfacing Having Coated Ceramic Particles or Coated Particles of Other Hard Materials* Ser. No. 09/008,117 filed Jan. 16, 1998 entitled *Inserts and Compacts Having Coated or Encrusted Cubic Boron Nitride Particles* Ser. No. 08/438,999 filed May 10, 1995 entitled *Method of Hard Facing a Substrate and Weld Rod Used in Hard Facing a Substrate*, now U.S. Pat. No. 5,667,903 dated Sep. 16, 1997; Ser. No. 08/579,454 filed Dec. 27, 1995 entitled *Hardfacing with Coated Diamond Particles*, now U.S. Pat. No. 5,755,299 dated May 26, 1998; and Ser. No. 08/818,468 filed Mar. 12, 1997 entitled *Hardfacing with Coated Diamond Particles*, now U.S. Pat. No. 5,755,298 dated May 26, 1998.

TECHNICAL FIELD OF THE INVENTION

The present invention relates in general to forming inserts and compacts having coated or encrusted diamond particles dispersed within a matrix body and, more particularly, to improved inserts and compacts to protect drill bits and other downhole tools associated with drilling and producing oil and gas wells.

BACKGROUND OF THE INVENTION

In the search for energy producing fluids, such as oil and gas, it is often necessary to bore through extremely hard formations of the earth. Drill bits used in this industry typically have three roller cones or cutter cones designed to scrape and gouge the formation. A cutter cone having broad, flat milled teeth can very effectively scrape and gouge the formation. However, as the formation being drilled becomes more dense and hard, such milled teeth wear quickly with accompanying reduction in drilling efficiency. Even when coated with an abrasion-resistant material, milled teeth often crack or break when they encounter hard formations. Thus, milled teeth are typically unsuitable for boring through high density rock.

To alleviate this problem, engineers developed cone inserts that are formed from a hard, abrasion-resistant material such as sintered and compacted tungsten carbide. Typically, such inserts or compacts have a generally frustoconical or chisel-shaped cutting portion and are rugged and extremely hard and tough. These physical properties are necessary to break and pulverize hard formations. These generally shorter, more rounded, and extremely hard and tough inserts function to crush the formation, as opposed to scraping, cutting and gouging pieces from the formation.

These heretofore utilized rock bits with inserts improved the penetration rates, resistance of insert or tooth wear and breakage, and maximized tolerance to impact and unit loading. However, problems exist in providing inserts that are more easily manufactured, have hard, wear resistant elements that are more easily retainable with the body of the insert and which are not cost prohibitive and can be easily obtained.

Rotary cone drill bits are often used for drilling boreholes for the exploration and production of oil and gas. This type of bit typically employs three rolling cone cutters, also known as rotary cone cutters, rotatably mounted on spindles extending from support arms of the bit. The cutters are mounted on respective spindles that typically extend downwardly and inwardly with respect to the bit axis so that the conical sides of the cutters tend to roll on the bottom of a borehole and contact the formation.

For some applications, milled teeth are formed on the cutters to cut and gouge in those areas that engage the bottom and peripheral wall of the borehole during the drilling operation. The service life of milled teeth may be improved by the addition of tungsten carbide particles to hard metal deposits on selected wear areas of the milled teeth. This operation is sometimes referred to as "hardfacing." U.S. Pat. No. 4,262,761, issued Apr. 21, 1981 discloses the application of hardfacing to milled teeth and is incorporated by reference for all purposes within this application.

For other applications, sockets may be formed in the exterior of the cutters and hard metal inserts placed in the sockets to cut and gouge in those areas that engage the bottom and peripheral wall of the borehole during the drilling operation. The service life of such inserts and cutters may be improved by carburizing the exterior surface of the cutters. U.S. Pat. No. 4,679,640 issued on Jul. 14, 1987 discloses one procedure for carburizing cutters and is incorporated by reference for all purposes within this application.

A wide variety of hardfacing materials have been satisfactorily used on drill bits and other downhole tools. A frequently used hardfacing includes sintered tungsten carbide particles in an alloy steel matrix deposit. Other forms of tungsten carbide particles may include grains of monotungsten carbide, ditungsten carbide and/or macrocrystalline tungsten carbide. Satisfactory binders may include materials such as cobalt, iron, nickel, alloys of iron and other metallic alloys. For some applications loose hardfacing material is generally placed in a hollow tube or welding rod and applied to the substrate using conventional welding techniques. As a result of the welding process, a matrix deposit including both steel alloy melted from the substrate surface and steel alloy provided by the welding rod or hollow tube is formed with the hardfacing. Various alloys of cobalt, nickel and/or steel may be used as part of the binder for the matrix deposit. Other heavy metal carbides and nitrides, in addition to tungsten carbide, have been used to form hardfacing.

Both natural and synthetic diamonds have been used in downhole drill bits to provide cutting surfaces and wear-resistant surfaces. U.S. Pat. No. 4,140,189 teaches the use of diamond inserts protruding from the shirttail surface of a roller cone bit. Polycrystalline diamond (PCD) gauge inserts are frequently used on a wide variety of drill bits to prevent erosion and wear associated with harsh downhole drilling conditions. U.S. Pat. No. 4,140,189 is incorporated by reference for all purposes within this application.

SUMMARY OF THE INVENTION

Accordingly, a need has arisen in the art for improved inserts and compacts for drill bits and other downhole tools associated with drilling and producing oil and gas wells. The present invention provides an insert or compact that substantially eliminates or reduces problems associated with the prior inserts and compact for drill bits and other downhole tools associated with drilling and producing oil and gas wells.

In one aspect of the invention, an insert for a ground engaging tool has a plurality of sockets for receiving a respective insert. The insert has a body having first and second portions and first and second zones. The first zone consists of tungsten carbide and metallic cobalt and is of preselected dimensions adapted for press fitting the first portion of the insert within a respective socket of the ground engaging tool. The second body portion defines an earth engaging portion of the insert. The second zone of the insert includes encrusted diamond pellets, tungsten carbide and metallic cobalt. These elements are fused together and fused with the elements of the first zone. The first zone is substantially free of encrusted diamond pellets and the second zone has encrusted diamond pellets distributed substantially throughout and entrapped by the tungsten carbide and metallic cobalt matrix. For some applications, each encrusted diamond pellet will preferably have a coating or encrustation with a thickness roughly equal to approximately one half the nominal diameter of the associated diamond particle.

In another aspect of the invention, a method is provided for forming inserts for ground engaging tools having a plurality of sockets each for receiving a respective end of one of the inserts. A container is provided. The container has a chamber having first and second zones, first and second ends, and a fill tube opening into a respective end of the container. A selected zone of the container is filled through the fill tube with one of a first mixture of powdered tungsten carbide and metallic cobalt and a second mixture of encrusted diamond pellets, powdered tungsten carbide and metallic cobalt. Thereafter the other zone of the container is filled through the fill tube with the other of the first and second mixtures. The container is thereafter hermetically sealed. The sealed, filled container is simultaneously heated and pressurized to a temperature and compaction for a time sufficient to sinter the tungsten carbide and metallic cobalt and fuse the mixture into a unitary body substantially free of degradation of the encrusted diamond pellets and with a plurality of metallurgical bonds formed between the exterior of each diamond particle and the respective encrusting material and between the encrusting material and the tungsten carbide, metallic cobalt matrix.

Other technical advantages will be readily apparent to one skilled in the art from the following figures, descriptions and claims.

BRIEF DESCRIPTION OF THE DRAWINGS

For a more complete understanding of the present invention and its advantages thereof, reference is now made to the following brief description, taken in conjunction with the accompanying drawings and detailed description, wherein like reference numerals represent like parts, in which.

DETAILED DESCRIPTION OF THE INVENTION

Figure 1:
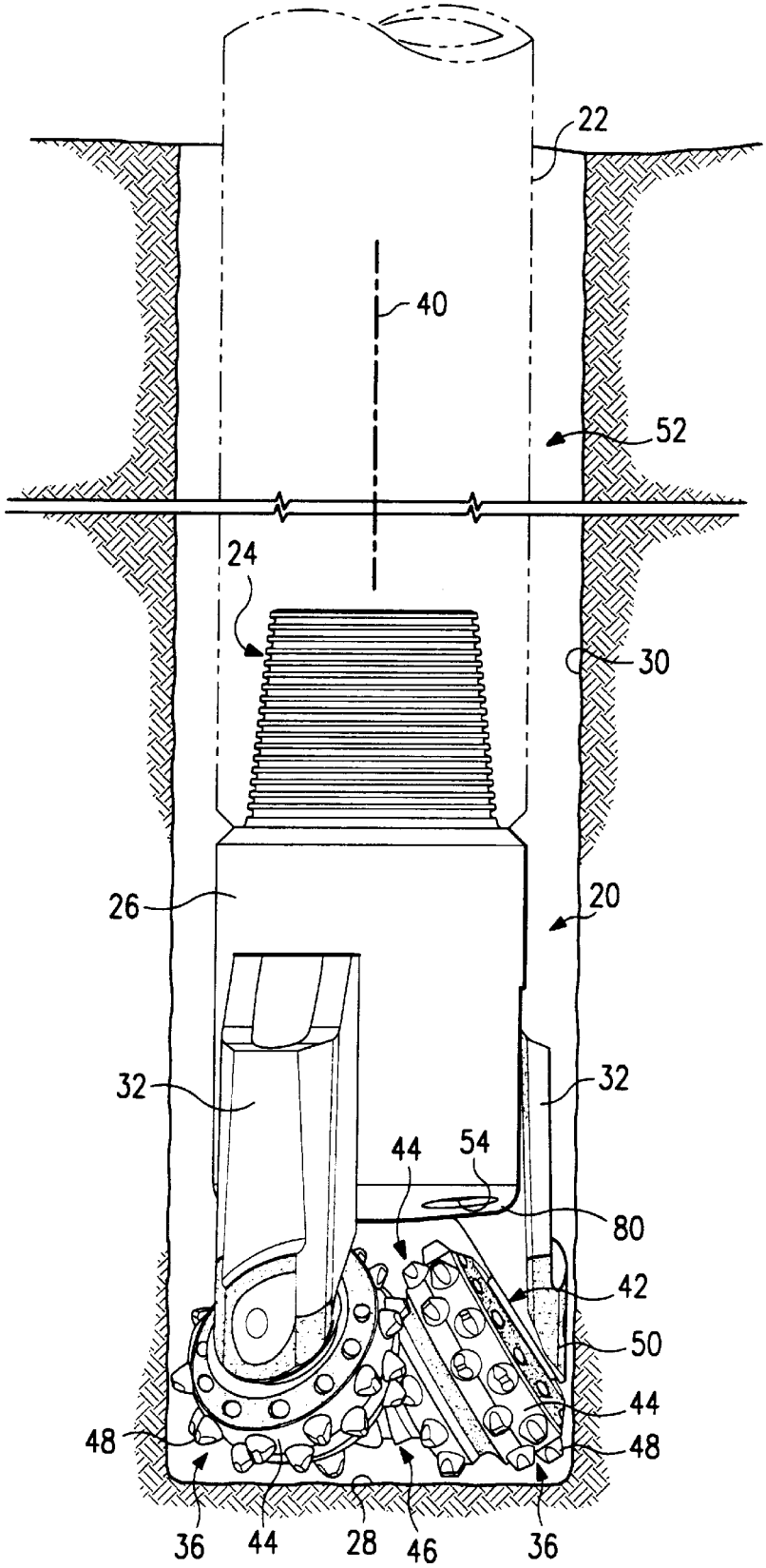
FIG. 1 is a schematic drawing in section and in elevation showing a drill bit with inserts or compacts formed in accordance with the teachings of the present invention at a downhole location in a wellbore.

The preferred embodiments of the present invention and its advantages are best understood by referring now in more detail to FIGS. 1–6 of the drawings, in which like numerals refer to like parts.

For purposes of the present application, the term "matrix body" is used to refer to various binders such as cobalt, nickel, copper, iron and alloys thereof may be used to form the matrix or binder portion of an insert or compact. Various metal alloys, ceramic alloys and cermets such as metal borides, metal carbides, metal oxides and metal nitrides may be included as part of the matrix body in accordance with the teachings of the present invention. Some of the more beneficial metal alloys, ceramic alloys and cermets will be discussed later in more detail.

For purposes of the present application, the term "metallurgical bond" is used to refer to strong attractive forces that hold together atoms and/or molecules in a crystalline or metallic type structure.

For purposes of the present application, the term "coating," "coated," "encrusted," and "encrusted portion" are used to refer to a layer of hard material which has been metallurgically bonded to the exterior of a diamond particle. The coating is preferably formed from sinterable materials including various metal alloys, ceramic alloys and cermets such as metal borides, metal carbides, metal oxides and metal nitrides. Some of the more beneficial metal alloys, ceramic alloys and cermets which may be used to form a coating on a diamond particle in accordance with the teachings of the present invention will be discussed later in more detail. For some applications each diamond particle will preferably be encrusted with a coating having a thickness equal to roughly one half the diameter of the respective diamond particle. As a result, the nominal diameter of the resulting encrusted diamond particle will be roughly twice the nominal diameter of the respective diamond particle. Forming a relatively thick coating or encrustation on each diamond particle allows establishing strong chemical or metallurgical bonds between each layer of coating or encrustation and the respective diamond particle and between each coating and adjacent portion of the matrix body of the respective insert or compact.

For purposes of the present application, the term "tungsten carbide" includes monotungsten carbide (WC), ditungsten carbide ($W_2C$), macrocrystalline tungsten carbide and cemented or sintered tungsten carbide. Sintered tungsten carbide is typically made from a mixture of tungsten carbide and cobalt powders by pressing the powder mixture to form a green compact. Various cobalt alloy powders may also be included. The green compact is then sintered at temperatures near the melting point of cobalt to form dense sintered tungsten carbide.

For purposes of the present application, the term "insert" and the term "compact" will be used interchangeably to refer to cutting or grinding elements in earth-boring drill bits and wear resistant elements associated with protecting drill bits and other downhole tools used for drilling and producing oil and gas wells. Inserts or compacts are often installed in a metal surface to prevent erosion, abrasion and wear of the metal surface.

Referring to FIG. 1, as is well known in the art and the petroleum industry, rotary drilling rigs rotate drilling bits 20 via drill collars 22 and a drill string (not shown). Drill bit 20 generally has three cutter cones 36. Additional information concerning this type of drill bit can be found in U.S. Pat. No.

5,606,895 entitled *Method for Manufacture and Rebuild of a Rotary Drill Bit*, which is incorporated into this application by reference only. This type of drill bit is currently being marketed by Security DBS, a Division of Dresser Industries, as the "New ERA" drill bit.

Drill bit 20 has a bit body 26. Bit body 26 has a threaded upper section adapted to be threadably attachable to drill collars 22. A power source (not shown) is located at the surface of the ground and rotates the drill string and drill collars 22 for rotating drill bit 20 in forcible contact with a bottom 28 and sidewalls 30 of the bore hole being drilled (see FIG. 1). The present invention may be used with drill bits attached to downhole drilling motors (not shown) and is not limited to use with conventional drill strings.

A lower section of drill bit 20 has a plurality of support arms 32 which are attached to the bit body and extend outwardly and downwardly from an outer surface 80 of bit body 26. Generally, rotary cone bits for drilling hard formations have three support arms 32 and associated cutter cones 36 and are referred to as tri-cone rock bits.

A spindle (not expressly shown) is connected to each support arm 32 and extends generally inwardly and downwardly toward the center and axis of rotation 40 of drill bit 20.

A cutter cone 36 is rotatably mounted on each of spindles. Each of cutter cones 36 has a base surface 42, a side surface 44 and an end 46. Side surface 44 of each cone 36 has a plurality of sockets (not shown)in spaced apart rows extending about cone side surface 44. Additional information about this type of drill bit can be found in U.S. Pat. No. 5,606,895 entitled *Method for Manufacture and Rebuild of Rotary Drill Bit*, which is incorporated into this application by reference only. Drill bits of this type are currently being marketed by the Security DBS, a division of Dresser Industries, as the "New ERA Bits."

Figure 2:
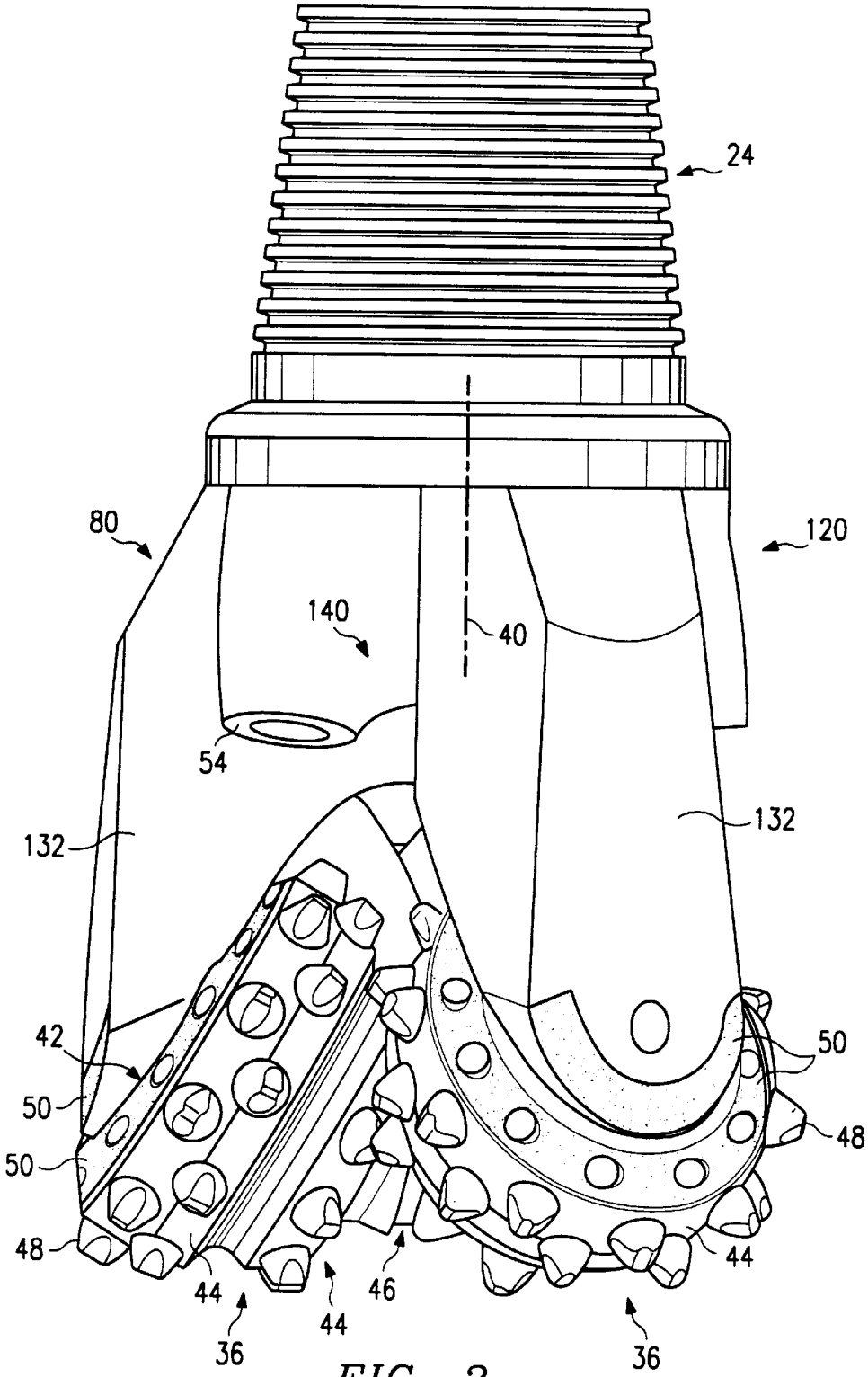
FIG. 2 is a schematic drawing in elevation showing another type of drill bit with inserts or compacts formed in accordance with teachings of the present invention.

Rotary cone drill bit 120 incorporating another embodiment of the present invention is shown in FIG. 2. Bit body 140 may be formed by welding three segments with each other to form bit body 140 having support arms 132 extending therefrom. Threaded connection 24 may be formed on upper portion of bit body 140 for use in attaching drill bit 120 to drill string 22. Additional information about this type of drill bit can be found in U.S. Pat. No. 5,429,200 entitled *Rotary Drill Bit with Improved Cutter*, which is incorporated into this application by reference only.

Referring to FIGS. 1 and 2, an insert 48 incorporating teachings of the present invention is preferably press fitted into each of the sockets and extends outwardly from side surface 44 of cone 36. Spindles and associated cones 36 are angularly oriented and inserts 48 are positioned such that as the drill bit 20 is rotated, cones 36 roll along the bottom 28 of the bore hole and chip and grind off portions of the formation and form a bore hole having a diameter greater than the diameter of bit body 26 and associated support arms 32 which partially defines annulus 52 to allow fluid flow to the well surface.

During drilling operations, great forces are exerted by drill bit 20 on the formation. As expected, these large forces may cause the bit body to momentarily come in contact with sidewalls 30 and be worn. Therefore, abrasion resistant material 50 sometimes referred to as "hardfacing" is generally placed on the lower portion of support arms 32 to prevent the arms from being worn away causing failure of drill bit 20. Abrasion resistant material 50 can be placed on other portions of drill bit 20 which may be subjected to undesirable wear.

The detrimental wear of portions of drill bit 20 is not only caused by sidewalls 30 of the drill bore, but by pieces of the formation that have been cut from the formation and are moving up an annulus 52 between the sidewalls 30 and the drilling equipment. These removed pieces of the formation are transported from the bore hole by drilling fluid (not shown) which is pumped down the drill string, drill collars 22, through the bit and forcibly from openings or nozzles 54 of drill bit 20.

Figure 3A:
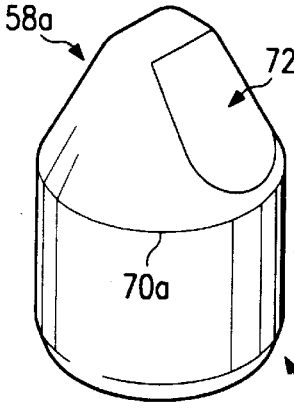
FIGS. 3A–D are schematic drawings showing isometric views of inserts having different configurations incorporating teachings of the present invention.
Figure 3B:
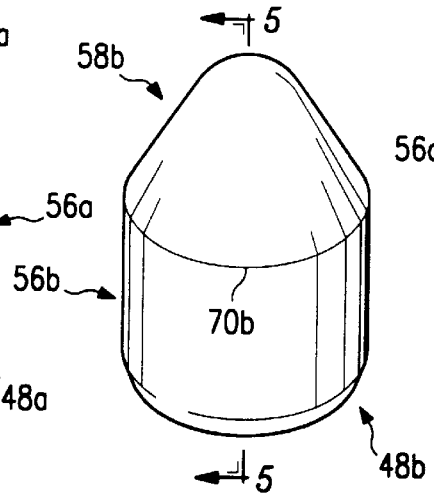
Figure 3C:
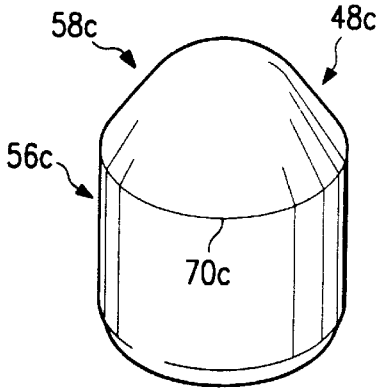

As shown in FIG. 3A, insert 48*a*, which contacts the formation and chips and grinds portions therefrom, has first and second portions 56*a* and 58*a* respectively. First portion 56*a* of insert 48*a* may be press fitted into respective sockets of a cutter cone 36. An interference fit between inserts 48*a* and the bottom and sidewalls of each socket retains each insert 48*a* within its respective socket.

First portion 56*a* of insert 48*a* has a generally cylindrical configuration. However, recently it has been discovered that these insert first portions 56*a* and their associated sockets are sometimes advantageously formed with other configurations in order to improve the interference fit between the socket and its respective insert 48*a*.

Such non-cylindrical sockets and first portions 56*a* of insert 48*a* each have a length, a width, and a depth and the depth is greater than about 0.8 times the width, the length is substantially less than or equal to 1.75 times the width, and the depth is in the range of about one to about 1.25 times the width. Preferably, the length is in the range of about 1.5 to about 1.6 times the width.

Second body portion 58*a* of the insert 48*a* is the element which contacts the formation during drilling and grinds pieces from the formation. As previously discussed, as the formation becomes more dense, it is necessary to shorten the length of an insert in order to produce more grinding forces. As shown in the various embodiments of FIG. 3, as the formation to be drilled becomes harder and more dense, the preferred configuration of the second portion 58 of the insert 48 will progress from embodiments 58*a*–58*d*. It should be noted that second portion 58*a* of insert 48*a* of FIG. 3A is longer and less dome shaped than second portion 58*d* of insert 48*d* of FIG. 3D. Therefore, the embodiment of FIG. 3D will typically produce greater drilling rates than the other embodiments when encountering extremely hard formations.

Figure 5:
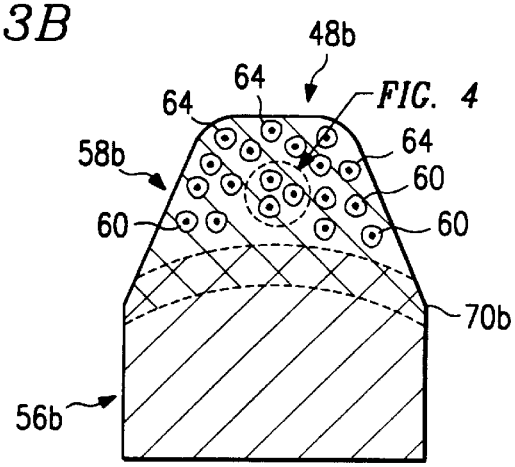
FIG. 5 is a schematic drawing in section taken along lines 5—5 of FIG. 3B showing one of many embodiments of an insert with wear resistant components incorporating teachings of the present invention.
Figure 4:
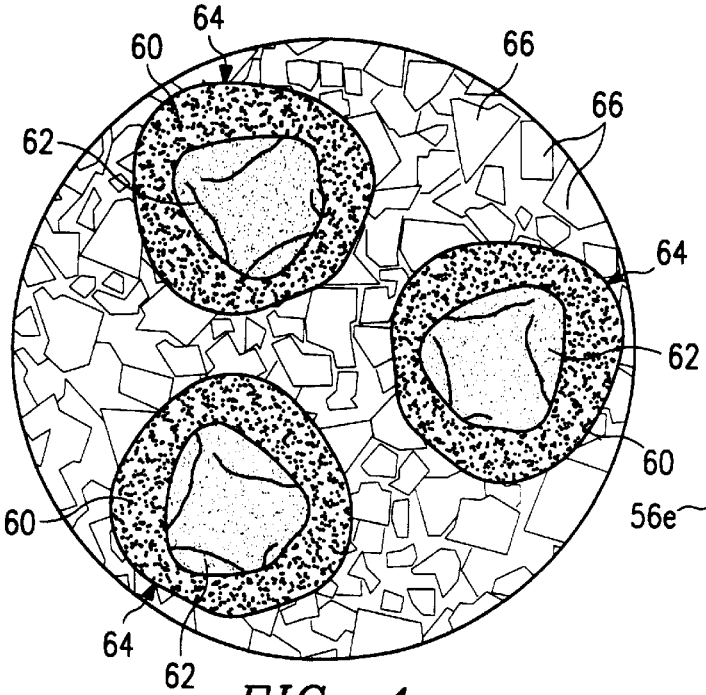
FIG. 4 is an enlarged schematic drawing in section showing a portion of a compact or insert having wear resistant components incorporating teachings of the present invention.
Figure 6:
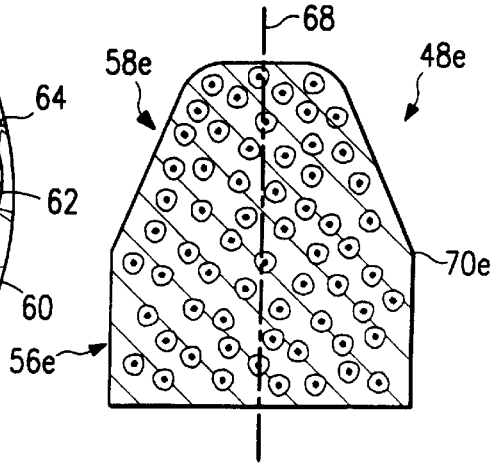
FIG. 6 is a schematic drawing in section showing an alternative embodiment of an insert with wear resistant components incorporating teachings of the present invention.

Referring to FIGS. 4–6, inserts or compacts incorporating teachings of the present invention have at least the respective second end portion 58 constructed with components having great abrasion resistance. The addition of various combination of elements to enhance abrasion resistance of the cutting portion of an insert is not new in the art. However, there is continuous effort in the industry to further improve the efficiency of drilling operations and hence the cutting elements associated with drill bits. It has been no surprise to research engineers in the petroleum industry that relatively minor and unique changes often produce greatly enhanced drilling efficiencies. Owing to the multiplicity of consistencies of rock formations, the design of drilling equipment is considered by many to be an art form as much as it is a science.

The second body portion 58 or rock grinding and crushing portion of an insert incorporating teachings of the present invention preferably includes encrusted or coated diamond particles, tungsten carbide, and a binder material selected from the group consisting of copper, nickel, iron, and/or cobalt-based alloys. More specifically, the preferred binding material for many downhole applications may be cobalt or cobalt-based alloys.

These components and elements are typically fused together with the first portion 56 of the respective insert to form unitary insert 48. The coated diamond particles of the fused insert are substantially free of heat degradation during fusing of the components and elements together and into preselected form in a single step of simultaneous heating and compacting. Such heat degradation may result if the diamond particles are not protected by a coating of hard material and/or if the heating and compacting exceed preselected limits.

Overheating of an insert containing coated diamond particles may result in degradation of the physical properties of hardness and toughness for the resulting insert. Such decline in the physical properties of the coated diamond particles generally does not occur where fusion takes place in a single, rapid compaction step which subjects the components and elements used to form the inserts in accordance with teachings of the present invention at lower temperatures.

Insert 48*b* has a body having first and second portions 56*b*, 58*b* and first and second zones 74, 76. First zone 74 of the insert consists of a first mixture of tungsten carbide and metallic cobalt and is of preselected dimensions adapted for press fitting the first portion of the insert within a respective socket of the ground engaging tool, for example drill bit 20.

It should be understood that inserts of this invention can also be used on other downhole drilling tools used in the petroleum industry. Example uses, without limitations, are the placement of inserts and compacts on downhole tools such as fixed cutter drill bits, sleeves for drill bits, coring bits, underreamers, hole openers, downhole stabilizers and shock absorber assemblies.

Second body portion 58*b* defines an earth engaging portion of insert 48*b*. Second body zone 76 of insert 48*b* consists of a second mixture of encrusted diamond pellets, tungsten carbide and metallic cobalt.

The first and second mixtures are fused together and to one another and form a unitary body having a first zone substantially free of encrusted diamond pellets and the second zone 76 having encrusted diamond pellets distributed substantially throughout and entrapped by the first mixture of tungsten carbide and metallic cobalt matrix.

Referring specifically to FIG. 5, it can be seen that insert zones 74, 76 are not necessarily restricted to respective first and second portion 56*b*, 58*b* of insert 48*b*. In this embodiment of insert 48*b*, first zone 74, which is substantially free of encrusted diamond pellets 64, includes the entire first portion 56*b* of insert 48*b*; i.e., that portion of insert 48*b* which is insertable in the socket and whose extremities are defined by the end of insert 48*b* and the dividing line 70. Additionally, the first zone 74 of this embodiment extends into a minor portion of the second insert portion 58*b*. By this construction, any grinding process which might be necessary to provide a durable press fit of insert 48*b*, will be assured of not encountering encrusted diamond pellets 64 which would make the grinding process more difficult and time consuming.

Referring to FIGS. 4–6, the coating or encrusted portion 60 of the encrusted diamond pellets 64 consist of metal alloys and cermets selected from the group consisting of metal borides, metal carbides, metal oxides, and metal nitrides. Preferably, the coating 60 is formed in part from tungsten carbide. The tungsten carbide, metallic cobalt matrix which is present in both portions 56*b*, 58*b* of insert 48*b* may also include alloys and cermets selected from the group consisting of metal borides, metal carbides, metal oxides and metal nitrides.

The encrusted diamond pellets 64 have a plurality of metallurgical bonds (not shown) formed between the exterior of each diamond particle 62 and the respective coating 60. There is also a plurality of metallurgical bonds formed between the coating 60 of the encrusted diamond pellet 64 and the tungsten carbide, metallic cobalt matrix.

Referring to FIG. 4, the encrusted diamond pellets 64 are substantially uniformly distributed in the second zone 76 of insert 64 in an amount the range of about twenty-five to about seventy-five percent by volume of the materials of the second zone, more preferably for some applications in the range of about forty to about fifty percent. For other applications, the second zone may be formed from approximately one hundred percent encrusted diamond pellets. Individual, discrete sintered tungsten carbide particles 66 can also form a portion of the second zone 76 of insert 48*b*.

Each of the diamond particles prior to coating is preferably of substantially the same size. However, these diamond particles prior to coating may be of different sizes without departing from this invention.

A preferred method of forming the compacts and inserts of this invention is by Rapid Omnidirectional Compaction (ROC). This process is a low-cost process for consolidating high-performance prealloyed powders into fully dense parts. The process has the ability of producing intricate or simple shapes with very fine microstructure and excellent mechanical properties due to the relatively low thermal exposure given the powder during the compaction process which is of short duration.

The Rapid Omnidirectional Compaction process is disclosed in U.S. Pat. No. 5,594,931 entitled *Layered Composite Carbide Product and Method of Manufacture*, U.S. Pat. No. 5,423,899 entitled *Dispersion Alloyed Hard Metal Composites and Method of Producing Same*, U.S. Pat. No. 4,956,012 entitled *Dispersion Alloyed Hard Metal Composites*, U.S. Pat. No. 4,744,943 entitled *Process for the Densification of Material Preforms*, U.S. Pat. No. 4,656,002 entitled *Self-Sealing Fluid Die*, and U.S. Pat. No. 4,341,557 entitled *Method of High Consolidating Powder with a Recyclable Container Material*, each of which is incorporated into this application by reference.

In the ROC process used in forming inserts or compacts of this invention, the compaction of the selected components and elements is accomplished during the heating process of the material which considerably and desirably shortens the time the diamond particles 62 are subjected to the possibility of heat degradation. In the process, a thick walled die having a cavity is typically employed. The die is a fluid die whose die walls entirely surround the cavity and are of sufficient thickness so that the exterior surface of the walls do not closely follow the contour or shape of the cavity. This insures that sufficient container material is provided so that, upon the application of heat and pressure, the container material will act like a fluid to apply hydrostatic pressure to the powder and particles in the cavity. The use of a thick-walled container produces a near net shape having close dimensional tolerances with a minimum of distortion. Powder articles of near net shapes are precision articles, compacts, or inserts requiring minimum finish machining or simple operations to produce a final desired shape.

A thick-walled container receives the powder and particles to be consolidated to form the densified powder compact or insert. The container preferably has first and second mating parts which, when joined together form a cavity for receiving the powder material and particles. The container is formed of material which melts at a combination of temperature and time at that temperature which combination would not undesirably or adversely affect the properties of the encrusted diamond particles.

The container is formed of a material that is substantially fully dense and incompressible and capable of plastic flow at elevated temperatures and/or pressures. The container will melt at a combination of temperature and time at that temperature. The container can, for example, be formed of copper and the mold for forming the container can be formed of cast iron.

The container may be subjected to a melting temperature above that which would adversely affect the properties of the diamond particles but for a short enough period of time that the heat would be taken up in the melting and the densification powder compact or insert would not itself reach a temperature level which would adversely affect its properties. Thus it is the combination of single step heating and short duration through compaction in a single step which protects the encrusted or coated diamond particles from undesirable structural change.

The container is filled with the material forming the insert or compact and thereafter hermetically sealed and positioned in a pressurizable autoclave. The filled container is simultaneously heated and pressurized. The temperature is maintained below the melting temperature of the material forming the container and the pressure is of a sufficient magnitude to cause plastic flow of the container walls, thereby subjecting the powder and particles to a hydrostatic pressure causing the powder to densify. The container can thereby be removed from about the formed insert or compact by various means known in the art.

The cavity of the container is filled via a fill tube which opens into one end of the container in communication with the container cavity. As with insert 48*b* to be formed, the container has first and second zones. The first zone of the container is filled with a first mixture consisting of powdered tungsten carbide and metallic cobalt. The second zone of the container is filled with a second mixture consisting of encrusted diamond pellets, powdered tungsten carbide and metallic cobalt. In order to assure that the first zone is substantially free of encrusted diamond pellets, where desirable, the filled container can be manipulated to settle the smaller granules into the first zone of the container. This manipulation can be done by several techniques, for example by vibrating the filled container.

In the method for forming inserts for a rock bit, the powder and particles of this invention can, for example, be subjected in the autoclave to a temperature of about 1000 to 1100° C., a pressure of about 10,000 to 50,000 psi for a time period of about one hour.

The encrustation protects the diamond particles 62 from degradation caused by heat in the presence of the elements of the second mixture. However, where the elements of the second mixture are subjected to prolonged heating as in previously utilized two step process of heating and pressurizing to form the unitary body, diamond degradation can often occur irrespective of the presence of encrustation.

The thickness of the coating 60 may be varied in response to the intended application. The coating 60 is preferably sintered after being placed on the respective diamond particle 62, thereby forming a pellet 64. The sintering process is used to form coated diamond pellets 64 having a density that is controllable relative to the other elements forming the insert 48*b*. Thus, coated diamond pellets 64 may be uniformly dispersed within the second portion 58*b* of insert 48*b* thereby providing an insert 48*b* of more uniform wear characteristics. A more uniform distribution of coated diamond pellets 64 also improves both the mechanical bonds and metallurgical bonds which secure the respective diamond particles 62 within insert 48*b*.

As can be seen in FIG. 4 and as previously discussed, insert 48*b* includes the uniformly dispersed encrusted diamond pellets 64 with interspersed tungsten carbide particles 66 bound together by a matrix. As insert 48b wears away during drilling operations, the matrix material, being softer and less tough, is the first to be eroded. This functions to further expose greater portions of the more abrasive tungsten carbide particles 66. As the carbide particles 66 become eroded the tougher and harder diamond particles 62 become more exposed and function to assume a progressive greater portion of the loads and abrasion imparted upon insert 48*b*. This continuous action functions to prolong the effective life of drill bit 20.

As previously touched upon, the configuration of the second portion 58*b* of insert 48*b* depends upon the toughness, density, and hardness of the rock expected to be drilled with the bit 20. The second body portion 58*b* of insert 48*b* has a preselected length as measured along insert axis 68 (see FIG. 6). This can readily be noticed by observing the dimensions of the second portion 58*a* of the embodiments of FIG. 3A where the dividing line between the first and second portions 56*a*, 58*a* of insert 20 has been indicated by numeral 70.

The embodiment of FIG. 3A has a second portion 58*a* which is relatively long and is of a chisel configuration where the outer end of the second portion 58*a* of the insert has one or more planar sides 72 defining a general tooth configuration. Such embodiment is particularly designed for the drilling of more easily drilled hard rock.

Figure 3D:
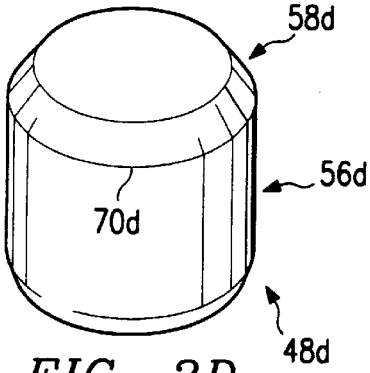

The embodiment of FIG. 3D has a second portion 58*d* which is relatively short and the outer end is planar. Such embodiment is particularly designed for the drilling of the most dense and hard rock. The other embodiments of FIG. 3 are of various domed configurations for the drilling of hard rock whose difficulty in drilling is intermediate to the extremes set forth with regard to FIGS. 3A and 3D.

Referring to FIG. 6, it should be understood that as the operator becomes more skilled in the formation of inserts of this invention, inserts will become more net shape. In such situations, the encrusted diamond pellets 64 can be included in both the first portion 56*e* and second portion 58*e* of the insert 48*e* since machining for press fit will not be necessary.

In accordance with the present invention, an insert may comprise coated diamond particles which may be metallurgically bonded with a matrix body to form the desired insert. The coated diamond particles are also mechanically held in place and protected by the surrounding matrix body which is preferably also formed from hard materials. The coated diamond particles are preferably dispersed within and both metallurgically and mechanically bonded with a matrix body formed from hard materials which are wear resistant. Cooperation between the wear resistant matrix body and the coated diamond particles provides inserts and compacts to better withstand abrasion, wear, erosion, and other stresses.

One aspect of the present invention includes providing inserts with coated diamond particles or encrusted diamond pellets dispersed throughout each insert. Another aspect of the present invention includes providing inserts with one or more layers of coated or encrusted diamond particles disposed therein. The resulting inserts are better able to withstand abrasion, wear, erosion and other stresses associated with repeated use in a harsh, downhole drilling environment.

Technical advantages of the present invention include providing inserts and compacts on selected portions of a drill bit to prevent undesired wear, abrasion and/or erosion of the protected portions of the drill bit.

The coated or encrusted diamond particles are preferably sintered prior to mixing with the other materials which will be used to form the inserts and compacts.

Technical advantages of the present invention include coating or encrusting diamond particles and sintering the coating to form chemical or metallurgical bonds between the coating and the surface of the associate diamond particle. Varying the composition of the coating and/or sintering, the coating can also be used to vary the density of the resulting coated diamond particles to be equal to or greater than the density of the hard materials used to form the associated matrix body prior to solidification. The coating on each diamond particle can also be reinforced with small grains of boride, carbide, oxide and/or nitride which cooperate with other components of the matrix body to improve retention of the coated diamond particles within the matrix body during erosion, abrasion and/or wear of the associated hardfacing.

The hard materials which will form the resulting matrix body and coated diamond particles disposed therein are preferably rapidly compressed and heated to form chemical or metallurgical bonds between the matrix body and the coating on each diamond particle. Both the matrix body and the coating can be formed from a wide variety of metallic and ceramic compounds in accordance with teachings of the present invention.

Further technical advantages of the present invention include coating or encrusting diamond particles which will protect the associated diamond particles from decomposition through exposure to high temperatures associated with forming compacts and inserts. As a result of the teachings of the present invention, the extreme hardness of diamond particles can be integrated into a slightly less hard but much tougher matrix body formed from materials such as tungsten carbide. The abrasion, erosion and wear resistance of the diamond particles is augmented by the hard materials selected to form the respective coating for each diamond particle. For example, when the hard materials selected to form the coating include cobalt, the tougher cementing phase of metallic cobalt will substantially improve the abrasion, erosion and wear resistance associated with diamond particles.

Although the present invention has been described with several embodiments, various changes and modifications may be suggested to one skilled in the art. It is intended that the present invention encompass such changes and modifications as fall within the scope of the present appended claims.

What is claimed is:

1. An insert for a rotary cone drill bit, the drill bit having a plurality of cones with each of the cones having a corresponding plurality of sockets for receiving one of the inserts, comprising:

a unitary body having first and second matrix body portions with different compositions;

the first matrix body portion being of preselected dimensions adapted for press fitting of the first matrix body portion within a respective socket of one of the cones, the second matrix body portion of the insert defining a cutting portion;

the second matrix body portion of the insert formed with encrusted diamond pellets, tungsten carbide, and a binder fused with each other, and the second matrix body portion fused with the first matrix body portion of the insert to form the unitary body;

each encrusted diamond pellet further comprising a diamond particle having a coating of hard material disposed on the exterior of the respective diamond particle with a plurality of first metallurgical bonds formed between the exterior of each diamond particle and the respective hard material coating; and each encrusted diamond particle substantially free of heat degradation;

the encrusted diamond pellets encapsulated in the second matrix body portion with a plurality of second metallurgical bonds formed between the respective hard material coating on each diamond particle and the second matrix body portion.

2. The insert, as set forth in claim 1, wherein the coating of the encrusted diamond pellets consist of metal alloys and cermets selected from the group consisting of metal borides, metal carbides, metal oxides, and metal nitrides.

3. The insert, as set forth in claim 1, wherein the encrusted diamond pellets comprise a range of about twenty-five percent to about seventy-five percent by volume of the second matrix body portion.

4. The insert, as set forth in claim 1, wherein the encrusted diamond pellets comprise a range of about forty to about fifty percent by volume of the second matrix body portion.

5. The insert, as set forth in claim 1, wherein the second matrix body portion includes a plurality of individual, discrete tungsten carbide particles.

6. The insert, as set forth in claim 1, wherein each diamond particle prior to coating has substantially the same size.

7. The insert, as set forth in claim 1, wherein the encrusted diamond pellets comprise a plurality of diamond particles having at least two different sizes prior to coating.

8. The insert, as set forth in claim 1, wherein the respective coating for the encrusted diamond pellets is formed in part from tungsten carbide.

9. The insert, as set forth in claim 1, further comprising zones of the insert which are substantially free of encrusted diamond pellets, said zones including the entire portion of the insert insertable into the socket and a minor portion of the second matrix body portion immediately adjacent the first matrix body portion.

10. The insert, as set forth in claim 1, wherein the unitary body further comprises alloys and cermets selected from the group consisting of metal borides, metal carbides, metal oxides, and metal nitrides.

11. The insert, as set forth in claim 10, wherein the coating defining the encrusted portion of the encrusted diamond pellets further includes alloys and cermets selected from the group consisting of metal borides, metal carbides, metal oxides, and metal nitrides.

12. The insert, as set forth in claim 10, wherein the second matrix body portion includes a plurality of sintered individual, discrete tungsten carbide particles.

13. An insert for a ground engaging tool having a plurality of sockets each for receiving a respective insert, comprising:

a body having first and second portions and first and second zones;

the first body portion defining a portion of the first zone, the first body portion formed in part from tungsten carbide and cobalt and having preselected dimensions adapted for press fitting of the first body portion within a respective socket of the ground engaging tool;

the second body portion defining an earth engaging portion;

the second body portion formed in part from encrusted diamond pellets and a matrix of tungsten carbide and cobalt;

each encrusted diamond pellet further comprising a diamond particle with a respective coating defining an encrusted portion of each encrusted diamond pellet consisting of metal alloys and cermets selected from the group consisting of metal borides, metal carbides, metal oxides, and metal nitrides;

a plurality of metallurgical bonds formed between the exterior of each diamond particle and the respective coating and a plurality of metallurgical bonds formed between the encrusted diamond pellets and the tungsten carbide, cobalt matrix; and the first zone of the insert being substantially free of encrusted diamond pellets and the second zone having encrusted diamond pellets distributed substantially throughout and entrapped by the matrix of tungsten carbide and cobalt.

14. The insert, as set forth in claim 13, wherein the encrusted diamond pellets comprise a range of about twenty-five percent to approximately one hundred percent by volume of the second zone.

15. The insert, as set forth in claim 13, wherein the second zone includes a plurality of individual, discrete tungsten carbide particles.

16. The insert, as set forth in claim 13, wherein the first zone of the insert includes the entire first body portion of the insert and a minor portion of the second body portion immediately adjacent the first body portion.

17. The insert, as set forth in claim 13, wherein the tungsten carbide and cobalt matrix further comprise alloys and cermets selected from the group consisting of metal borides, metal carbides, metal oxides, and metal nitrides.

18. The insert, as set forth in claim 13, wherein the first portion is sized to be received in a respective socket formed in one of a rotary cone drill bit, a fixed cutter drill bit, a sleeve of a drill bit, a coring bit, an underreamer, a hole opener, a downhole stabilizer or a shock absorber assembly.

* * * * *